United States Patent [19]

Wagner

[11] Patent Number: 4,583,477

[45] Date of Patent: Apr. 22, 1986

[54] OVERHAND SEWING MACHINE WITH CLUTCH-ACTUATED CONVEYING DISK DRIVE

[75] Inventor: Hans Wagner, Munich, Fed. Rep. of Germany

[73] Assignee: J. Strobel & Sohne GmbH & Co., Fed. Rep. of Germany

[21] Appl. No.: 661,798

[22] Filed: Oct. 17, 1984

[30] Foreign Application Priority Data

Oct. 18, 1983 [DE] Fed. Rep. of Germany ..... 3337876

[51] Int. Cl.[4] ..... D05B 27/14

[52] U.S. Cl. ..... 112/322; 112/47; 112/220; 226/181; 192/24; 192/66; 192/0.02 R; 271/114

[58] Field of Search ..... 112/318, 322, 28, 47, 112/220, DIG. 3; 226/187, 181; 271/114; 192/0.02 R, 0.096, 24, 66

[56] References Cited

U.S. PATENT DOCUMENTS

| | | | |
|---|---|---|---|
| 768,111 | 8/1904 | Burghardt | 112/288 |
| 1,443,962 | 2/1923 | Moffatt . | |
| 1,518,520 | 12/1924 | Klemm . | |
| 2,105,097 | 1/1938 | Poole | 112/47 |
| 2,990,092 | 6/1961 | Begun et al. | 226/187 X |
| 3,076,305 | 2/1963 | Meisser | 192/66 X |
| 3,177,992 | 4/1965 | Ayers | 192/0.096 |
| 3,625,168 | 12/1971 | Palazzo | 112/318 |
| 4,010,700 | 3/1977 | Webb | 112/220 X |
| 4,182,248 | 1/1980 | Klages | 112/322 X |
| 4,201,145 | 5/1980 | Blessing | 112/318 X |
| 4,258,639 | 3/1981 | Bonalumi | 112/322 |
| 4,280,425 | 7/1981 | Croyle | 112/DIG. 3 |
| 4,318,360 | 3/1982 | Uemura et al. | 112/318 |

FOREIGN PATENT DOCUMENTS

| | | |
|---|---|---|
| 943926 | 6/1956 | Fed. Rep. of Germany . |
| 1804370 | 5/1970 | Fed. Rep. of Germany . |
| 2076865 | 12/1981 | United Kingdom . |

*Primary Examiner*—Werner H. Schroeder
*Assistant Examiner*—Andrew M. Falik
*Attorney, Agent, or Firm*—Bacon & Thomas

[57] ABSTRACT

An overhand sewing machine for the sewing of innersoles to the shanks of shoes comprises two driven conveying disks, an inner conveying disk in contact with the shank material, and an outer conveying disk in contact with the innersole material, the outer disk being displaceable with respect to the inner disk in order to be pressured by spring-loading against the inner disk, and to be capable of moving away against the spring-loading from the inner disk, as required for the insertion of the material to be sewn into the overhand sewing machine. In order to avoid difficulties in sewing along narrow curves with relatively small radii of curvature, in particular along the heel rounding of the innersole and the shank of the shoe, a clutch is provided to interrupt the drive of the outer disk, the clutch being preferably located between two mutually coaxial shafts for the drive of the outer disk, while having the configuration of a clamp or friction clutch, and being actuated by a motor controlled by the operating personnel, and disengageable when sewing along a narrow curve so that only the inner disk is driven, while the outer disk remains in idle.

10 Claims, 1 Drawing Figure

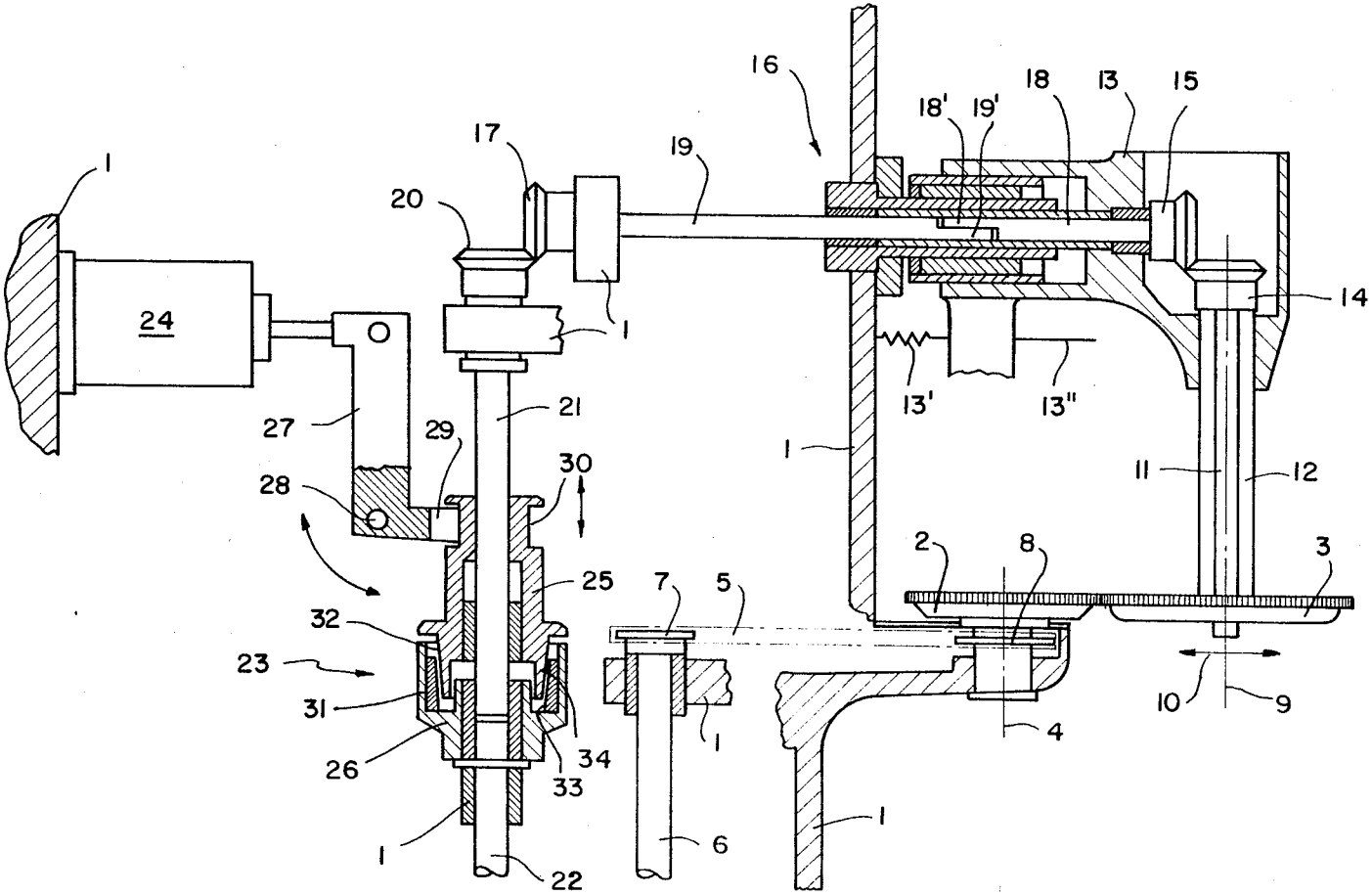
14
15
13
18
19'
18'
16
19
17
20
21
1
12
11
13''
13'
3
9
10
8
2
4
5
7
6
30
25
34
33
22
29
27
28
32
31
26
23
24

OVERHAND SEWING MACHINE WITH CLUTCH-ACTUATED CONVEYING DISK DRIVE

BACKGROUND OF THE INVENTION

1. Field of the Invention

The invention relates to an overhand sewing machine for the sewing of innersoles to the shank with two driven conveying disks applied, respectively, against the innersole and shank material.

2. Description of the Prior Art

Overhand sewing machines of this type are used in the production of turned shoes. In this process, specific difficulties are encountered while sewing along the heel curve of the innersole and the shank, because of the relatively small radius of the arc along which sewing must take place and because, due to the thickness of the inner sole and shank materials, the lengths of the rolling paths of the conveying disks may be different to the extent that the material to be sewn may become warped and/or wedged between the transport disks.

Overhand sewing machines are already known (DE-OS No. 18 04 370) wherein the two conveying disks may be driven with different step length, and it is also known to use such overhand sewing machines in the manufacture of turned shoes. However, it is difficult to set the mutual relationships of the lengths of the steps with the accuracy required for the sewing of an innersole to the shank of a shoe in order to obtain a satisfactory conveyance of The material to be sewn along the heel rounding of the innersole and the shank.

SUMMARY OF THE INVENTION

It is an object of the invention to provide an overhead sewing machine of the aforementioned type, whereby the difficulties described above are eliminated in a simple manner and sewing is made possible along narrow curves with relatively small radii of curvature, in particular along the heel rounding of the innersole and the shank of the shoe.

In an overhand sewing machine according to the invention, during the sewing of an innersole to the shank of the shoe shortly before the heel rounding of the innersole and the shank is reached, a clutch is provided for the interruption of the drive of the outer conveying disk acting on the material of the innersole. Thus, only the inner conveying disk in contact with the material of the shank is driven in a stepwise manner, while the outer conveying disk is carried along without being driven. The outer conveying disk is displaceable with respect to the inner conveying disk and spring-loaded toward the inner disk and displaceable against the action of the spring loading away from the inner disk, as required for the insertion of the material to be sewn into the overhand sewing machine. In this manner, any warping of the material and its wedging by the conveying disk are prevented.

Even though the invention is concerned primarily with an overhand sewing machine for the sewing of innersoles to the shanks of shoes, it may also be applied to other sewing machines with two driven transport disks for the material to be sewn, wherein sewing must be effected along narrow curves with relatively small radii of curvature and through which the aforedescribed difficulties may be encountered.

BRIEF DESCRIPTION OF THE DRAWING

The single FIGURE depicts the invention in schematic form, particularly showing the two conveying disks and their drive mechanisms.

DETAILED DESCRIPTION OF THE PREFERRED EMBODIMENT

An overhand sewing machine, as schematically shown in the FIGURE, for the sewing of innersoles to the shanks of shoes has a configuration including a housing 1 and two driven conveying disks 2 and 3 for the material to be sewn, of a conventional type, aside from the drive mechanism for the outer conveying disk 3, which is in contact during the sewing process with the material of the innersole, whereby the two conveying disks 2 and 3 are driven in opposing directions in order to transport the material being sewn perpendicularly to the plane of the drawing.

The inner conveying disk 2 is supported rotatingly around a vertical axle 4 in the housing 1 of the overhand sewing machine and connected by means of an endless toothed belt 5 with a vertical shaft 6 again bearingly supported in rotation in the housing 1 to drive the inner conveying disk 2. The toothed belt 5 is looped around a tooth gear 7 on the shaft 6 and a toothed ring 8 on the inner conveying disk 2.

The outer conveying disk 3 is also supported by a bearing means for rotation about a vertical axle 9 and is located in the same horizontal plane as the inner conveying disk 2, wherein it is displaceable with respect to the latter in the direction of the double arrow 10, in particular under the action of a spring load toward the inner conveying disk 2 and against the effect of the spring load away from the inner conveying disk 2, in order to clamp and hold the material to be sewn between the two conveying disks 2 and 3 or to move the outer conveying disk 3 away from the inner transport disk 2, as required for the insertion of the material being sewn into the overhand sewing machine.

The outer conveying disk 3 is mounted on the lower end of a vertical shaft 11, which is supported by a bearing means for rotation in a sleeve 12 of a support arm 13 for the outer conveying disk 3 and is equipped on the upper end with a bevel wheel 14. The support arm 13 is supported for displacement in the direction of the double arrow 10 in the housing 1 of the overhand sewing machine. Arm 13 is biased by a spring 13' connected between arm 13 and housing 1 toward inner conveying disk 2, and is movable against the action of spring 13' through a linkage 13'', the latter being actuated by an appropriate means (not shown), e.g. a pedal. The bevel wheel 14 engages a bevel wheel 15 mounted on the adjacent end of a variable length telescopic shaft 16, extending in the direction of movement of the outer conveying disk 3, i.e. parallel to the double arrow 10 and provided with a further bevel wheel 17 at its other end. The telescopic shaft 16 consists of two mutually coaxial shaft pieces 18 and 19, equipped, respectively, with the bevel wheel 15 and the other bevel wheel 17, rotatingly supported in the support arm 13 and the housing 1, respectively, and positively joined together at their adjacent ends 18' and 19', respectively in a manner such that the shaft piece 18 of the support arm 13 may be displaced with respect to the other shaft piece 19 in case of a movement of the outer conveying disk 3 or its support arm 13 in the direction of the double arrow 10, without severing the rotating connection between the two shaft pieces 18 and 19. For this purpose, ends 18' and 19' interengage along an axially extending radial plane, as shown.

A bevel wheel 20 engages the bevel wheel 17 of the telescopic shaft 16 and the shaft piece 19, respectively, said wheel 20 being mounted on the adjacent end of a vertical rotating shaft 21 located in the housing 1 of the overhand sewing machine and driving the outer conveying disk 3 together with a further vertical shaft 22, also supported bearingly in rotation in the housing 1. The two shafts 21 and 22 are coaxial with respect to each other and a clutch 23 is provided between them, said clutch being actuated by means of a double acting actuating cylinder 24 mounted on the housing 1.

The clutch 23 is in the form of a clamping or friction clutch and comprises two sleeves 25 and 26, which are displaceable in opposing directions. One sleeve 25 is axially displaceable on one of the vertical shafts 21, but is immobilized against rotation, for example by means of a keyway connection, and is adjustable on the shaft 21 by means of the actuating cylinder 24 with a pivot lever 27, said lever being mounted pivotingly on the housing 1 of the overhand sewing machine around a horizontal axle 28 that is perpendicular to the shaft 21, and engages with a forked end 29 by means of two rollers provided on said end, an annular groove 30 of the sleeve 25. The other sleeve 26 is fastened to the adjacent end of the other vertical shaft 22 and is equipped with an internal friction ring 31 fixedly joined to the sleeve 26.

Each of the two sleeves 25 and 26 is provided with a conical contact surface 32 and 33, tapering in the direction from the axially displaceable sleeve 25 toward the axially immobilized sleeve 26. The contact surface 32 of the axially displaceable sleeve 25 is located on the outside on a cylindrical extension of said sleeve 25, while the contact surface 33 of the axially immobile sleeve 26 is inside on its friction ring 31. The axially displaceable sleeve 25 projects with its cylindrical extension 34 into the friction ring 31 of the axially immobile sleeve 26, so that the two conical contact surfaces 32 and 33 of the sleeves 25 and 26 with their mutually compatible configurations are facing each other.

When the overhand sewing machine is in operation, the two mutually parallel shafts 6 and 22 are both intermittently driven. One shaft 6 rotates the inner conveying disk 2 by means of the toothed belt 5 and the other shaft 21 the outer conveying disk 3 by means of the vertical shaft 21, the telescopic shaft 16 and the suspension shaft 11 of the outer conveying disk 3, in corresponding steps, when the clutch 23 is engaged. If in the course of the sewing operation the drive of the outer conveying disk 3 is to be interrupted, so that only the inner conveying disk is being driven in a stepwise manner and the outer conveying disk 3 is running along in idle, the cylinder 24 is actuated to open or disengage the clutch 23 and to pivot the pivot lever 27 around the axle 28 counterclockwise, so that the axially displaceable sleeve 25 is caused to move away on the appropriate vertical shaft 21 from the other sleeve 26 on the other vertical shaft 22, whereby the two sleeves 25 and 26 are disengaged from each other and the two conical contact surfaces 32 and 33 lift off each other, as shown. The actuation of the actuating cylinder 24 may be effected by means of a valve and a pedal connected with said valve through a mechanical linkage and exposing, upon its depression by the operating personnel of the overhand sewing machine, the double acting pneumatic cylinder 24 to the pressure of compressed air through the valve, said cylinder otherwise being under the pressure of compressed air so that it compresses the two sleeves 25 and 26, thereby holding them in mutual engagement.

If during the sewing of an innersole to the shank of a shoe the seam is started on one side of the innersole and the shank and the material of the innersole sewn together with the shank material in the direction of the tip of the shoe, along said tip and away from it, the clutch 23 is engaged and the two conveying disks 2 and 3 are driven intermittently and synchronously with approximately equal step lengths on the circumference, except along the tip of the shoe, where the inner conveying disk 2 in contact with the shank material is being driven with a step length that is larger to some extent on the circumference than that of the outer conveying disk 3 in contact with the material of the innersole, in order to gather the shank material which, in this area, has an excess width. Shortly before reaching the heel rounding of the innersole and the shank, the clutch 23 is opened or disengaged and maintained in this condition until the material of the innersole and the shank are sewn together along the heel rounding of the innersole and the shank, so that any warping of the material being sewn and any wedging together of the material and the conveying disks 2 and 3 is prevented. The clutch 23 is then closed or engaged in order to again drive the conveying disks 2 and 3 intermittently during the remaining part of the sewing process, if the seam joining the innersole has not been started at the corresponding end of the heel rounding of the innersole and the shoe shank.

I claim:

1. Overhand sewing machine for the sewing of innersoles to the shank of shoes with two driven conveying disks (3 and 2) in contact with the material of the innersole and the shank, respectively, with each disk being intermittently rotated by a corresponding driving means (22 and 6), comprising a clutch (23) for disconnecting one of the conveying disks (3) from its corresponding driving means (22) while the other conveying disk continues to be intermittently rotated.

2. Overhand sewing machine according to claim 1, wherein the clutch (23) is disposed between two mutually coaxial shafts (21 and 22) for driving the conveying disk (3).

3. Overhand sewing machine according to claim 2, wherein the clutch (23) is in the form of a clamp or friction clutch.

4. Overhand sewing machine according to claim 3, wherein the clutch (23) includes two sleeves (25 and 26) displaceable longitudinally in opposing directions, with opposing conical contact surfaces (32 and 33), the sleeve (25) being mounted on one shaft (21) in an axially displaceable manner but fixedly in rotation, and the other sleeve (26) being mounted on the other shaft (22).

5. Overhand sewing machine according to claim 4, wherein at least one sleeve (26) is provided with a friction coating or friction ring (31), on which the conical contact surface (33) of the sleeve (26) is formed.

6. Overhand sewing machine according to claim 1 further including a motor for actuating the clutch (23).

7. Overhand sewing machine according to claim 6, wherein the motor is a pneumatic actuating cylinder (24).

8. Overhand sewing machine for the sewing of innersoles to the shank of shoes with an outer conveying disk (3) in contact with the material of the innersole and intermittently rotated by a driving means (22) and with an inner conveying disk (2) in contact with the material of the shank and intermittently rotated by a further driving means (6), the driving means (22) including a clutch (23) for disconnecting the outer conveying disk (3) from its driving means (22), the outer driving disk (3) being loaded by a spring (13') in the direction of the inner conveying disk (2) and displaceable against the action of the spring (13') away from the inner conveying disk (2).

9. Overhand sewing machine according to claim 8 wherein the clutch (23) is disposed between two mutually coaxial shafts (21 and 22) for driving the outer conveying disk (3) and drivingly connected to the outer conveying disk (3) by a variable length telescopic shaft (16) that extends parallel to the direction of the movement (10) of the outer conveying disk (3).

10. Overhand sewing machine according to claim 9, wherein the two mutually coaxial shafts (21 and 22) are disposed perpendicular to the telescopic shaft (16) and parallel to the axes of rotation (4 and 9) of the two conveying disks (2 and 3) and to a shaft defining the driving means (6) for driving the inner conveying disk (2).

* * * * *